US011491607B2

(12) United States Patent
Persson

(10) Patent No.: US 11,491,607 B2
(45) Date of Patent: Nov. 8, 2022

(54) SUPPORT ELEMENT FOR USE IN COMBINATION WITH A GRINDING APPARATUS FOR SHARPENING AN EDGE TOOL

(71) Applicant: Tormek AB, Lindesberg (SE)

(72) Inventor: Håkan Persson, Lindesberg (SE)

(73) Assignee: TORMEK AB, Lindesberg (SE)

( * ) Notice: Subject to any disclaimer, the term of this patent is extended or adjusted under 35 U.S.C. 154(b) by 940 days.

(21) Appl. No.: 16/274,983

(22) Filed: Feb. 13, 2019

(65) Prior Publication Data

US 2019/0255673 A1 Aug. 22, 2019

(30) Foreign Application Priority Data

Feb. 19, 2018 (SE) ..... 1850183-3

(51) Int. Cl.
*B24B 41/06* (2012.01)
*B24B 3/36* (2006.01)
(Continued)

(52) U.S. Cl.
CPC ..... *B24B 41/066* (2013.01); *B24B 3/36* (2013.01); *B24B 3/38* (2013.01); *B24B 27/02* (2013.01); *B24B 41/06* (2013.01)

(58) Field of Classification Search
CPC .... B24B 3/00; B24B 3/36; B24B 3/38; B24B 27/02; B24B 41/06; B24B 41/066
(Continued)

(56) References Cited

U.S. PATENT DOCUMENTS 2,107,921 A * 2/1938 Weed ..... B24B 41/066 451/380
2,421,358 A * 5/1947 Sneva ..... B24B 3/065 451/396

(Continued)

FOREIGN PATENT DOCUMENTS

DE 7242191 U 3/2014
EP 2946881 A1 11/2015

(Continued)

OTHER PUBLICATIONS

Extended European Search Report for EP Application No. 19156715.5 dated May 24, 2019 (9 pages).

(Continued)

*Primary Examiner* — Joel D Crandall
*Assistant Examiner* — Makena S Markman
(74) *Attorney, Agent, or Firm* — Knobbe Martens Olson & Bear LLP

(57) ABSTRACT

The present disclosure presents a grinding apparatus for sharpening an edge tool. The grinding apparatus may comprise a grinding apparatus casing; a cylindrical grindstone and a support element. The cylindrical grindstone is removably attachable to the grinding apparatus casing. The support element is also removably attachable to the grinding apparatus casing for supporting the edge tool to be sharpened during the grinding operation. The support element includes an elongated member, which may be embodied as a cylindrical support bar. The cylindrical support bar may be configured to extend in a direction which is perpendicular to the rotation axis of the cylindrical grindstone, during operation, in such way that a grinding operation is enabled where the edge tool to be sharpened can be sharpened by means of the side surface facing outwardly from the grinding apparatus casing during the grinding operation.

7 Claims, 8 Drawing Sheets

(51) Int. Cl.
*B24B 3/38* (2006.01)
*B24B 27/02* (2006.01)

(58) Field of Classification Search
USPC ..... 451/406, 367, 380, 387, 460, 371
See application file for complete search history.

(56) References Cited

U.S. PATENT DOCUMENTS

| | | | | |
|---|---|---|---|---|
| 2,565,309 | A * | 8/1951 | Jacoby, Jr. | B24B 19/16 82/115 |
| 5,301,473 | A * | 4/1994 | Seear | B24B 41/066 451/367 |
| 5,941,763 | A | 8/1999 | Kaye | |
| 6,848,971 | B2 * | 2/2005 | Doman | B24B 47/22 451/410 |
| 7,524,236 | B2 | 4/2009 | Schwaiger et al. | |
| 2011/0212671 | A1 * | 9/2011 | Scherl | B24B 41/066 451/340 |

FOREIGN PATENT DOCUMENTS

| | | |
|---|---|---|
| EP | 2946881 B1 | 10/2017 |
| EP | 3059048 B1 | 10/2017 |

OTHER PUBLICATIONS

Search Report for Swedish Patent Application No. 1850183-3, dated Sep. 11, 2018.

* cited by examiner

SUPPORT ELEMENT FOR USE IN COMBINATION WITH A GRINDING APPARATUS FOR SHARPENING AN EDGE TOOL

INCORPORATION BY REFERENCE TO PRIORITY APPLICATION

This U.S. patent application claims the benefit of priority to Swedish Patent Application Number 1850183-3, filed on Feb. 19, 2018, the contents of which are hereby incorporated by reference herein.

TECHNICAL FIELD

The present disclosure generally relates the field of grinding apparatuses. In particular, some of the aspects and embodiments described herein relate to a grinding apparatus for sharpening an edge tool. In addition, some of the aspects and embodiments described herein relate to a support element for use in combination with such grinding apparatus.

BACKGROUND

Edge tools, such as edge tools for woodworking (e.g. woodturning tools) or knives, generally have to be sharp in order to obtain desired results. Sharpening may be performed by means of a rotating grindstone in a grinding apparatus.

An example of a conventional grinding apparatus 1 is shown in FIG. 1. The grinding apparatus 1 is provided with an essentially cylindrical grindstone 2. The grindstone 2 is driven by a motor, e.g. an electrical motor (not shown), which is typically placed inside a housing (or, casing) of the grinding apparatus 1.

The grinding apparatus 1 is sometimes also provided with support means 3 in the vicinity of the grindstone 2. As indicated in FIG. 1, a common purpose of the support means 3 is to serve as a guiding means for an edge tool 4 to be sharpened by the grindstone 2. In the exemplary grinding apparatus 1 shown in FIG. 1, the support means 3 is embodied as a cylindrical support bar, which is sometimes referred to as a universal bar. The cylindrical support bar 3 is essentially parallel with the rotation axis of the grindstone 2. In general, two cylindrical ends (or legs) 3', 3" of the cylindrical support bar 3 are to be inserted in respective holes 5', 5" of brackets 6 that are placed on a top surface of the grinding apparatus 1.

In conventional grinding apparatuses, the cross-section of each hole 5', 5" is typically circular in order to achieve a desired clamping force against the respective cylindrical ends 3', 3" when the cylindrical ends 3', 3" are inserted into the respective holes 5', 5". Furthermore, the position of the cylindrical support bar 3, and thus the distance between the cylindrical support bar 3 and the grindstone 2, may be adjusted to suit different needs or purposes for grinding different edge tools 4 by the grindstone 2. Said position of the cylindrical support bar 3 may e.g. be fixed by a set screw 7.

Recently, the applicant TORMEK AB has proposed a novel grinding apparatus where one of the holes 5' or 5" may be provided with a non-circular cross-section. According to the European Patent No. EP 2 946 881 B1, a grinding apparatus for sharpening an edge tool may comprise a grindstone having a rotation axis; and a motor adapted to drive the grindstone such that the grindstone is capable of rotating around its rotation axis; a support bar arranged in parallel to said rotation axis, wherein the support bar is for supporting the edge tool and wherein the support bar further comprises first and second cylindrical ends extending parallel to each other outwardly from the support bar; and a grinding apparatus casing comprising a first bracket and a second bracket, the first bracket comprising a first hole adapted to receive the first cylindrical end of the support bar, and the second bracket comprising a second hole adapted to receive the second cylindrical end of the support bar simultaneously, wherein the first and second cylindrical ends are removable from the first and second holes, respectively, and wherein one of the first hole or the second hole comprises a circular cross-section, and characterized in that the other of the first hole or the second hole comprises a non-circular cross-section. An example of such grinding apparatus is illustratively shown in FIG. 2. FIG. 2 corresponds to FIG. 6 in the published EP 2 946 881 B1.

Referring back to FIG. 1, a grinding jig 8 may also be provided in order to assist the user of the grinding apparatus 1 to hold the edge tool 4 correctly in relation to the grindstone 2 and on the cylindrical support bar 3 during a grinding operation when the user sharpens his or her edge tool 4.

Optionally, the grinding apparatus 1 may also comprise a wheel 9 for honing as is known in the existing art, and as is schematically illustrated in FIG. 1.

SUMMARY

It is in view of the background art described hitherto that the various aspects and embodiments of the present invention have been made.

A general object is to provide a grinding apparatus that is increasingly flexible for a user in the sense that the grinding apparatus can provide the user with several different options or choices during his/her grinding operation, e.g. with respect to a grinding angle of the edge tool to be sharpened.

The above-mentioned general object has been addressed by the appended independent claims. Advantageous embodiments have been defined in the appended dependent claims.

According to a first aspect, there is provided a support element for use in combination with a grinding apparatus. The support element is removably attachable to the grinding apparatus. That is, the support element can be removably attached to the grinding apparatus. Furthermore, the support element comprises a removably attached cylindrical support bar for supporting an edge tool to be sharpened during a grinding operation. The cylindrical support bar comprises a first cylindrical leg and a second cylindrical leg. Furthermore, the first cylindrical leg and the second cylindrical leg are parallel to each other and extend outwardly from the cylindrical support bar. The support element comprises a first support element section removably attachable to an upper surface of a grinding apparatus casing of the grinding apparatus and further configured to extend outwardly from the grinding apparatus casing, when the grinding apparatus is in operation. The support element further comprises a second support element section which is pivotally coupled to the first support element section. The second support element section includes first and second holes configured to simultaneously receive the first and second cylindrical legs of the cylindrical support bar for removably attaching the cylindrical support bar to the support element. Furthermore, said cylindrical bar cylindrical support bar is configured to extend in a direction which is perpendicular to a rotation axis of a cylindrical grindstone of the grinding apparatus when in operation in combination with the grinding apparatus in such way that a grinding operation is enabled where the edge tool to be sharpened can be sharpened by means of a parallel side surface facing outwardly from the grinding apparatus casing during the grinding operation.

In some embodiments, the second support element section includes fastening elements configured for fastening the first and second cylindrical legs in the first and second holes, respectively.

In some embodiments, the first support element section comprises a beam-shaped element configured to extend in a direction parallel to the rotation axis of the cylindrical grindstone when the grinding apparatus is in operation, and wherein the first support element section further comprises a third cylindrical leg and a fourth cylindrical leg, wherein the third cylindrical leg and the fourth cylindrical leg are parallel to each other and configured to extend outwardly from the beam-shaped element towards a center portion of the upper surface of the grinding apparatus.

In some embodiments, one of the first or second holes of the second support element section comprises a circular cross-section and the other of the first or second holes of the second support element section comprises a non-circular cross-section. For example, the non-circular cross-section may be an oval cross-section.

According to a second aspect, there is provided a grinding apparatus for sharpening an edge tool. The grinding apparatus comprises a i) grinding apparatus casing, ii) a cylindrical grindstone removably attached to the grinding apparatus casing, the cylindrical grindstone having two parallel side surfaces and a circular periphery surface between said two parallel side surfaces, and the cylindrical grindstone further being rotatable around a rotation axis which is perpendicular to both parallel side surfaces of the cylindrical grindstone; and iii) a support element according to the first aspect, which is removably attached to the grinding apparatus for supporting an edge tool to be sharpened during a grinding operation.

In some embodiments, the grinding apparatus casing comprises a first bracket and a second bracket, and wherein each bracket includes a respective hole configured to receive the earlier-mentioned third and fourth cylindrical legs of the first support element section simultaneously. For example, each bracket may further include a fastening element configured for fastening the third and fourth cylindrical legs in the holes of the first and second brackets, respectively. According to a third aspect, there is provided a grinding apparatus for sharpening an edge tool. The grinding apparatus comprises a grinding apparatus casing (sometimes interchangeably referred to as a grinding apparatus housing or, alternatively, simply housing). Furthermore, a cylindrical grindstone is removably attached to the grinding apparatus casing. In general, the cylindrical grindstone has two parallel side surfaces and a circular periphery surface between said two parallel side surfaces. Moreover, the cylindrical grindstone is rotatable around a rotation axis which is typically perpendicular to both parallel side surfaces of the cylindrical grindstone. For example, a motor (e.g., an electrical motor) may be adapted to drive the cylindrical grindstone such that the cylindrical grindstone is capable of rotating around its rotation axis. As described in the background section, the motor may be positioned or otherwise placed inside the grinding apparatus housing. Still further, a support element is removably attached to the grinding apparatus casing for supporting the edge tool to be sharpened during a grinding operation. As will be appreciated, a jig device (sometimes referred to as a grinding jig) may additionally be removably attached to the support element for assisting the user of the grinding apparatus to hold the edge tool to be sharpened correctly in relation to the cylindrical grindstone and the support element. Furthermore, the above-mentioned support element includes an elongated member which is configured to extend in a direction which is perpendicular to the rotation axis of the cylindrical grindstone in such way that a grinding operation is enabled where the edge tool to be sharpened can be sharpened by means of the parallel side surface facing outwardly from the grinding apparatus casing during the grinding operation.

In some embodiments, the above-mentioned support element may comprise a first support element section pivotally coupled to a second support element section. The first element section may be removably attached to an upper surface of the grinding apparatus casing and configured to extend outwardly from the grinding apparatus casing, when the grinding apparatus is in operation. The second support element section may include the earlier-mentioned elongated member. The first support element section may be pivotally coupled (e.g., by means of a swivel joint or a pivot hinge) to the second support element section to enable positioning of the elongated member in relation to the cylindrical grindstone. For example, it is made possible to position the elongated member to extend in a direction which is perpendicular to the rotation axis of the cylindrical grindstone in such way that a grinding operation is enabled where the edge tool to be sharpened can be sharpened by means of the parallel side surface facing outwardly from the grinding apparatus casing during the grinding operation.

In preferred embodiments, the elongated member advantageously comprises a support bar, such as a cylindrical support bar (universal bar).

For example, the cylindrical support bar may additionally comprise a first cylindrical leg and a second cylindrical leg, wherein the first cylindrical leg and the second cylindrical leg are parallel to each other and extend outwardly from the cylindrical support bar.

In one embodiment, the support element further comprises a first support element section which is removably attached to an upper surface of the grinding apparatus casing and configured to extend outwardly from the grinding apparatus casing, when the grinding apparatus is in operation; a second support element section which is pivotally coupled (e.g., by means of a swivel joint or a pivot hinge) to the first support element section; and wherein the second support element section includes first and second holes configured to receive the first and second cylindrical legs of the cylindrical support bar simultaneously.

For example, the second support element section may include fastening elements configured for fastening the first and second cylindrical legs in the first and second holes, respectively.

Additionally, or alternatively, the first support element section may comprise a beam-shaped element configured to extend in a direction parallel to the rotation axis of the circular grindstone when the grinding apparatus is in operation, and the first support element section further comprises a third leg (e.g., a cylindrical leg) and a fourth leg (e.g., a cylindrical leg), wherein the third leg and the fourth leg are parallel to each other and configured to extend outwardly from the beam-shaped element, for example towards a center portion of the upper surface of the grinding casing.

In some embodiments, the grinding apparatus casing comprises a first bracket and a second bracket, and each bracket includes a respective hole configured to receive the third and fourth cylindrical legs of the first support element section simultaneously. For instance, each bracket may further include a fastening element configured for fastening the third and fourth legs in the holes of the first and second brackets, respectively.

In some embodiments, one of said first or second holes of the second support element section may comprise a circular cross-section and the other of said first or second holes of the second support element section may comprise a non-circular cross-section. For example, the non-circular cross-section may be an oval cross-section.

According to a fourth aspect, there is provided a support element configured to be removably attached to a grinding apparatus (e.g. a grinding apparatus casing thereof), the support element further being configured for supporting an edge tool to be sharpened during a grinding operation. The support element includes an elongated member which is configured to extend in a direction perpendicular to the rotation axis of a cylindrical grindstone in such way that a grinding operation is enabled where an edge tool to be sharpened can be sharpened by means of a side surface facing outwardly from the grinding apparatus during a grinding operation.

In some embodiments, the above-mentioned support element may comprise a first support element section pivotally coupled to a second support element section. The first element section may be removably attachable to an upper surface of the grinding apparatus (e.g. a grinding apparatus casing thereof). The second support element section may include the earlier-mentioned elongated member. The first support element section may be pivotally coupled (e.g., by means of a swivel joint or a pivot hinge) to the second support element section to enable positioning of the elongated member in relation to the cylindrical grindstone of the grinding apparatus.

In preferred embodiments, the elongated member may be a support bar, such as a cylindrical support bar. In one embodiment, the cylindrical support bar may further comprise a first cylindrical leg and a second cylindrical leg, wherein the first cylindrical leg and the second cylindrical leg are parallel to each other and extend outwardly from the support bar.

In some embodiments, the support element may further comprise a first support element section which is removably attachable to an upper surface of the grinding apparatus (e.g. a grinding apparatus casing thereof) and extending outwardly from the grinding apparatus, when the grinding apparatus is in operation; a second support element section which is pivotally coupled (e.g., by means of a swivel joint or a pivot hinge) to the first support element section; and wherein the second support element section includes first and second holes configured to receive the first and second cylindrical legs of the cylindrical support bar simultaneously.

For instance, the second support element section may include fastening elements configured for fastening the first and second cylindrical legs in the first and second holes, respectively.

In some embodiments, the first support element section may comprise a beam-shaped element that is capable of extending in a direction parallel to the rotation axis of the cylindrical grindstone when the grinding apparatus is in operation, and wherein the first support element section further comprises a third leg (e.g., a cylindrical third leg) and a fourth leg (e.g., a cylindrical fourth leg), wherein the third leg and the fourth leg are parallel to each other are capable of extending outwardly from the beam-shaped element, for example towards a center portion of an upper surface of the grinding apparatus.

In some embodiments, the third and fourth legs are configured to be received by respective brackets of the grinding apparatus simultaneously. As will be appreciated, the grinding apparatus (e.g., the grinding apparatus casing thereof) may for example be provided with a first bracket and a second bracket, wherein each bracket includes a respective hole configured to receive the third and fourth legs of the first support element section simultaneously. Advantageously, but not necessarily, each bracket may further include a fastening element configured for fastening the third and fourth legs in the holes of the first and second brackets, respectively.

In advantageous embodiments, one of said first or second holes of the second support element section may comprise a circular cross-section and the other of said first or second holes of the second support element section may comprise a non-circular cross-section. For example, the non-circular cross-section may be an oval cross-section.

The various aspects and embodiments described in this disclosure allow for grinding operations where an edge tool to be sharpened can be sharpened by means of the parallel side surface facing outwardly from the grinding apparatus casing during the grinding operation. This may achieve the advantageous effect that it is made possible to sharpen edge tools using an even grinding phase. According to some embodiments, the grinding apparatus is also flexible in that the support element can be used with either horizontal or vertical brackets positioned at an upper side (top side) of the grinding apparatus. This allows the user to find multiple different positions in his/her attempt to find an optimal position for sharpening his or her edge tool.

BRIEF DESCRIPTION OF THE DRAWINGS

The various embodiments of the invention will be described in further detail below under reference to the accompanying drawings, in which.

DETAILED DESCRIPTION

The present invention will now be described more fully hereinafter. The present invention may, however, be embodied in many different forms and should not be construed as limited to the embodiments set forth herein; rather, these embodiments are provided by way of example so that this disclosure will be thorough and complete, and will fully convey the scope of the invention to those persons skilled in the art. Like reference numbers refer to like elements throughout the description.

Figure 1:
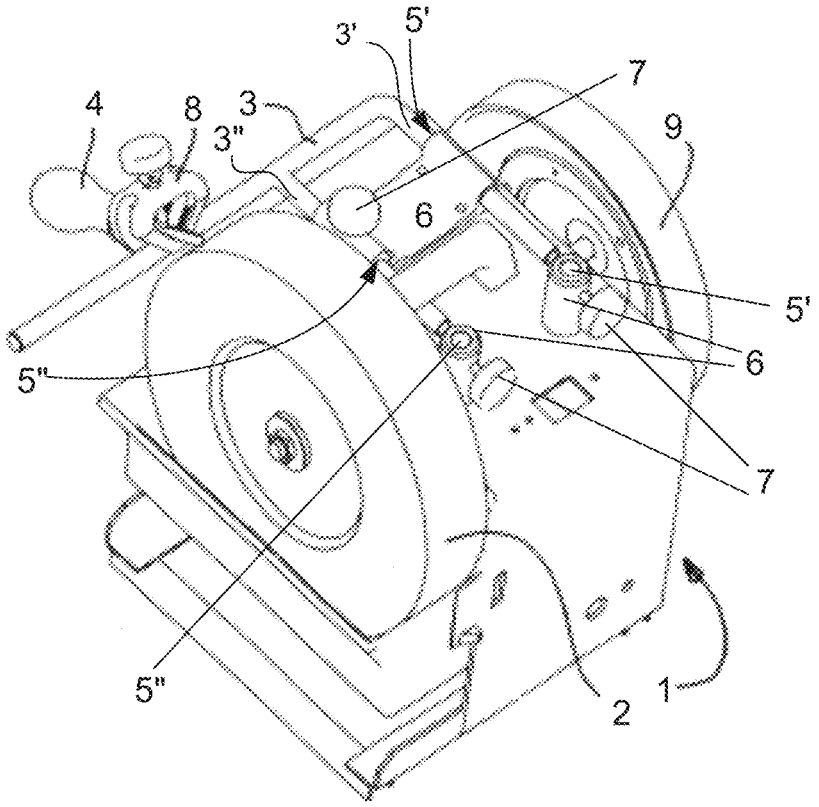
Figure 1 (Prior Art)
FIG. 1 is a perspective view of an exemplary grinding apparatus according to the existing art.
Figure 2:
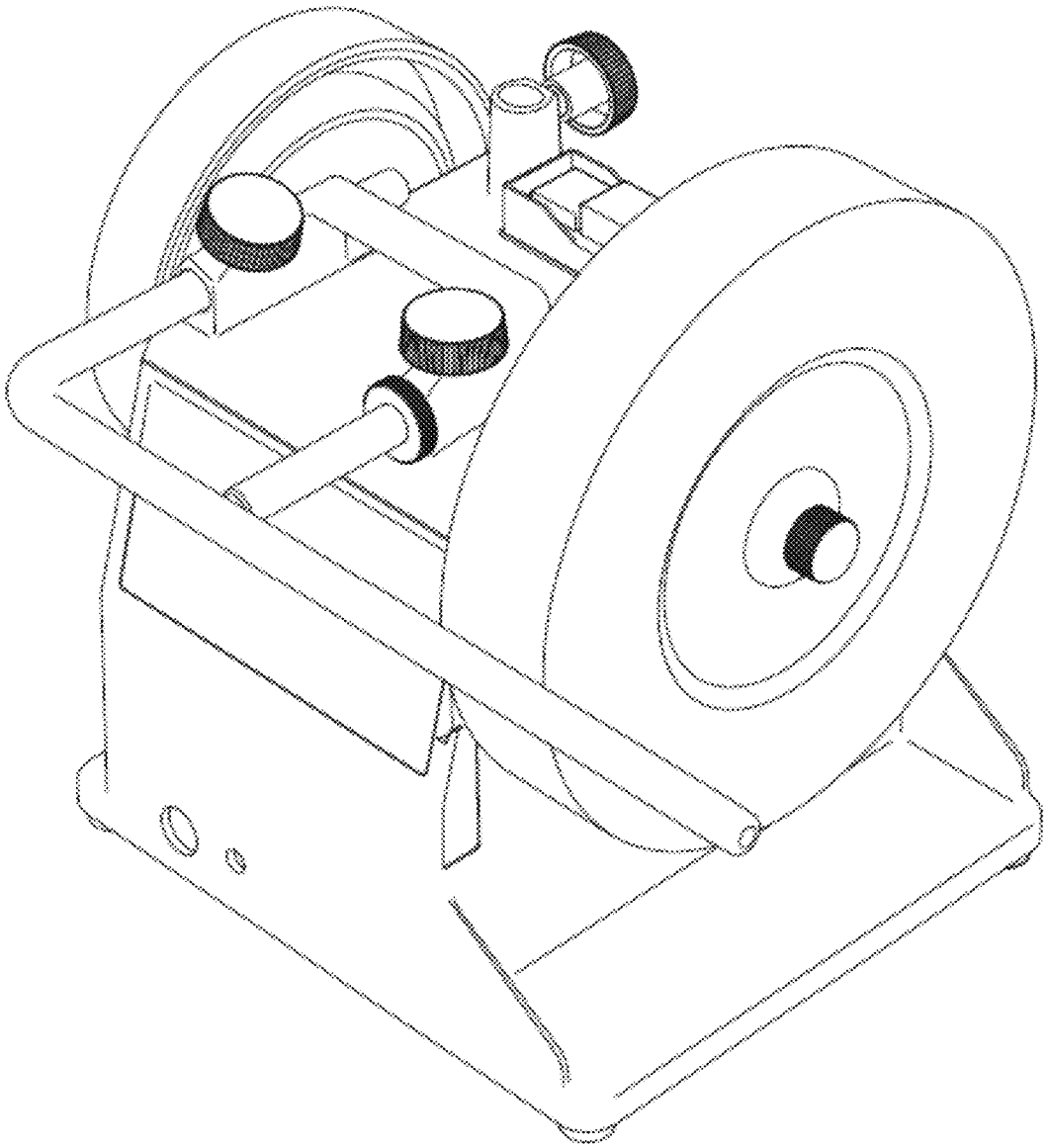
Figure 2 (Prior Art)
FIG. 2 is a perspective view of a grinding apparatus according to the European Patent EP 2 946 881 B1 (existing art)
Figure 3:
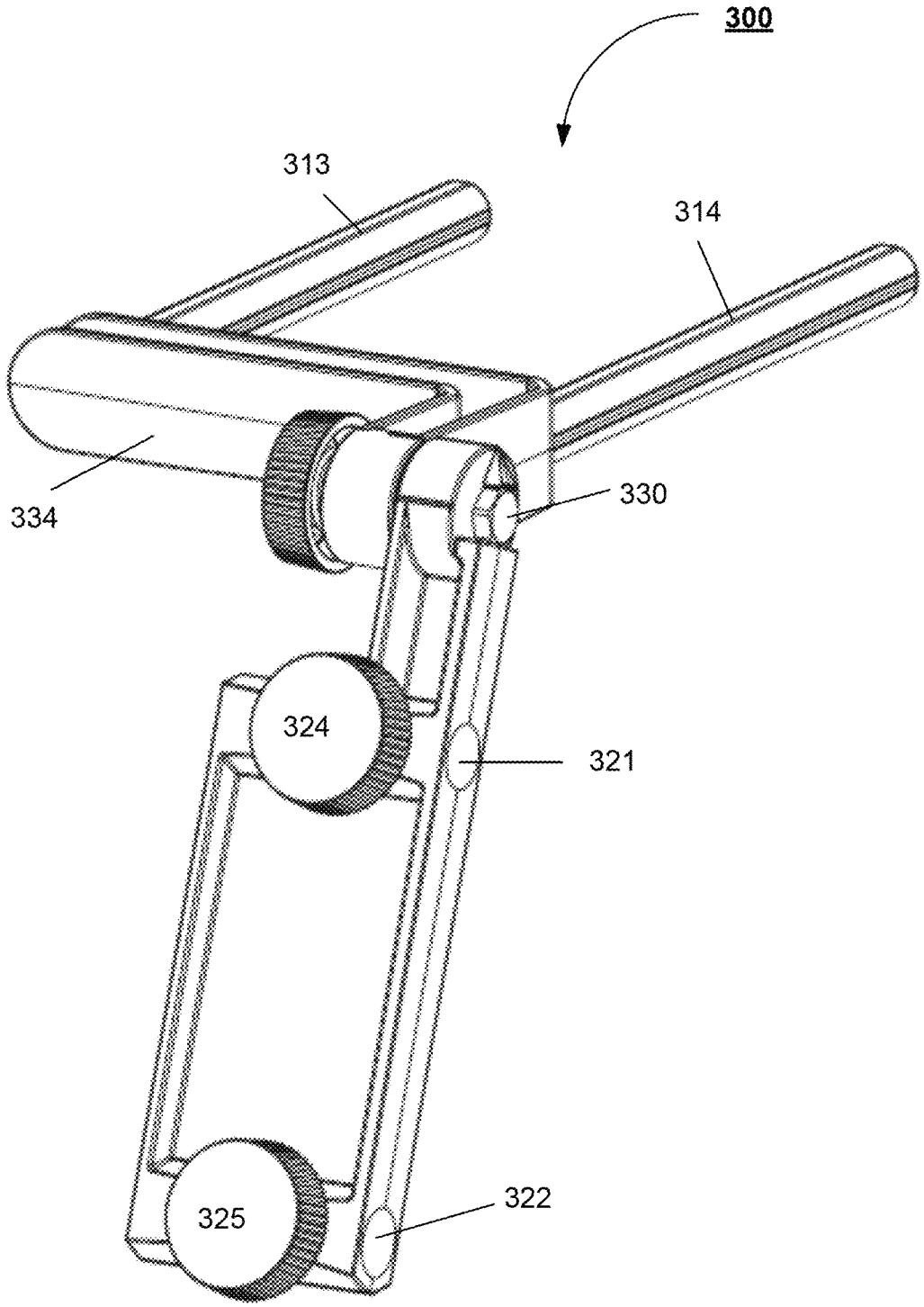
FIG. 3 is an exemplary view of a support element according to an embodiment.

As will be further detailed herein, this disclosure proposes a support element 300 for use in combination with a grinding apparatus 100. The support element 300 and the grinding apparatus 100 will be further detailed herein with reference to FIGS. 3-8. FIG. 3 illustrates an example embodiment of parts of the support element 300 in a non-operative state. FIGS. 4-8 illustrate example embodiments of the support element 300 when the support element 300 is removably attached to the grinding apparatus 100. In the following, the support element 300 will be described primarily in relation to the grinding apparatus 100 (i.e., when in operation or when in use in combination with the grinding apparatus 100) in order to ease the understanding of the various aspects and embodiments of the present invention. This shall not be construed as limiting.

Figure 4:
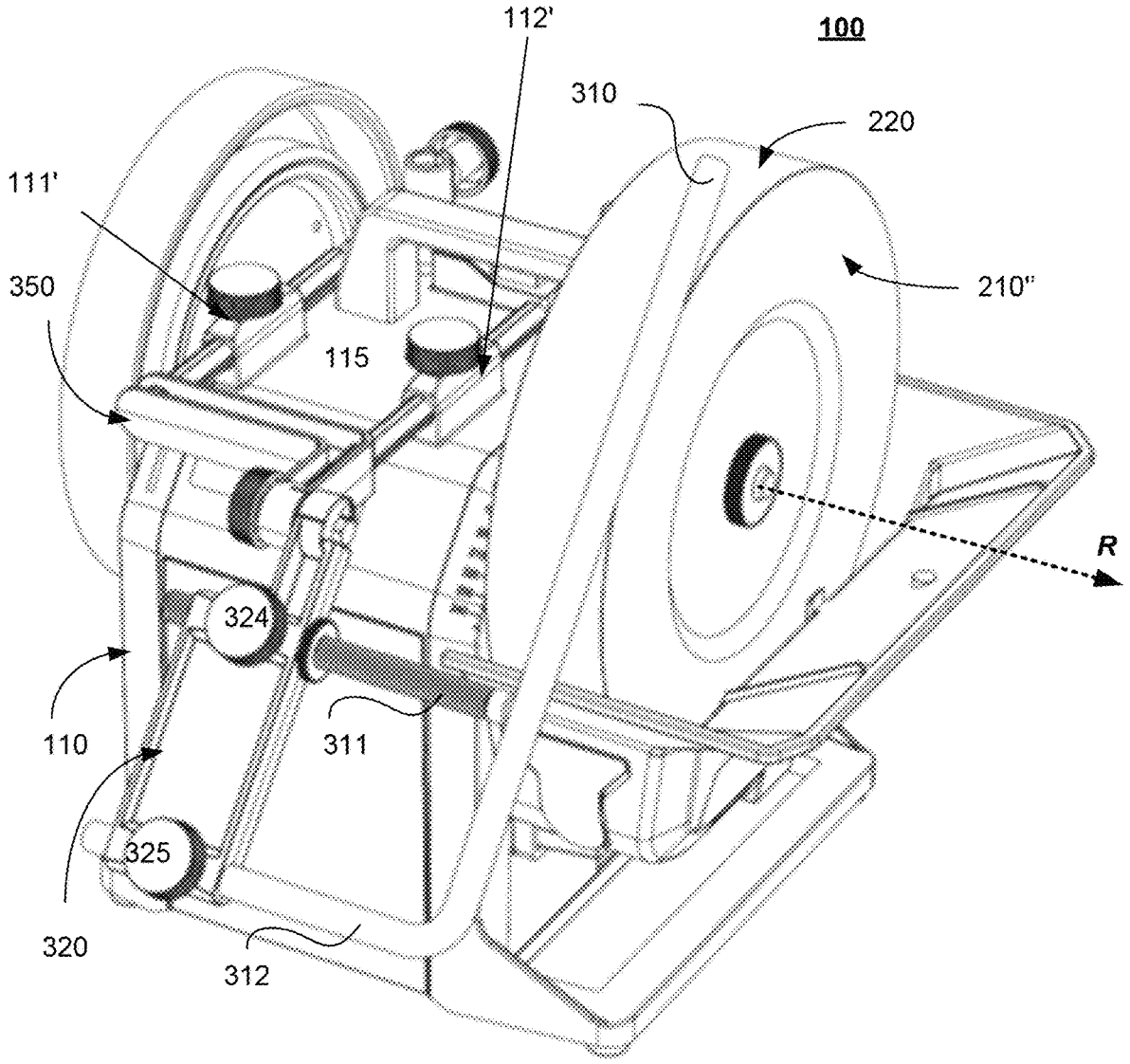
FIG. 4 is an exemplary view of the support element in FIG. 3 when the support element is removably attached to a grinding apparatus.

Reference is initially made to FIG. 4, which schematically illustrates the support element 300 in FIG. 3 when the support element 300 is removably attached to a grinding apparatus 100. In general, the grinding apparatus is configured to be used for sharpening an edge tool 400 (see e.g. FIG. 6). In particular, grinding apparatuses 100 are commonly used for assisting users (not shown) to sharpen edge tools (e.g., edge tools for woodworking (e.g. woodturning tools) or knives) with repetitively proper sharpening results.

The grinding apparatus 100 may comprise a grinding apparatus casing 110, sometimes referred to as a grinding apparatus housing. Furthermore, a cylindrical grindstone 200 is provided for enabling grinding operations. The cylindrical grindstone 200 is removably attached to the grinding apparatus casing 110. Moreover, the cylindrical grindstone 200 typically has two parallel side surfaces 210', 210" and a circular periphery 220 surface between said two parallel side surfaces 210', 210". As is appreciated, the cylindrical grindstone 200 is rotatable around a rotation axis, denoted R in the drawings. The rotation axis R is typically perpendicular to the two parallel side surfaces 210', 210" of the cylindrical grindstone 200. For example, a motor (e.g., an electrical motor) (not shown) is provided for driving the cylindrical grindstone 200 such that the cylindrical grindstone 200 is capable of rotating around its rotation axis R. As described in the background section, the motor may advantageously (but not necessarily) be positioned or otherwise placed inside the grinding apparatus 100.

According to the various aspects and embodiments described herein, the support element 300 includes an elongated member 310 configured to extend in a direction D which is perpendicular to the rotation axis R of the cylindrical grindstone 200 in such way that a grinding operation is enabled where the edge tool 400 to be sharpened can be sharpened by means of the parallel side surface 210" facing outwardly from the grinding apparatus casing 110 during the grinding operation. This is for example illustrated in FIGS. 5 and 6.

Figure 5:
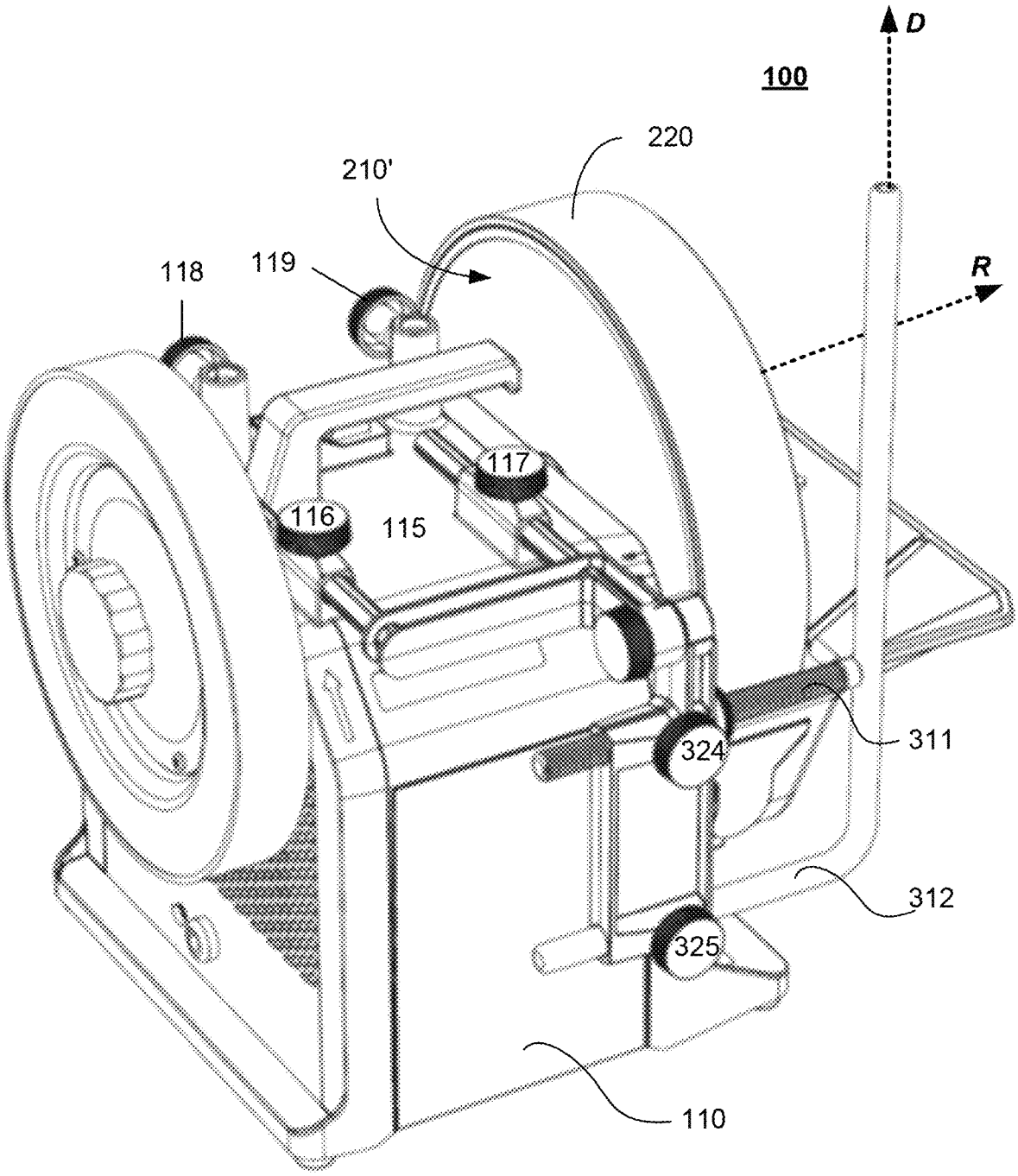
FIG. 5 is another exemplary view of the support element in FIG. 3 when the support element is removably attached to a grinding apparatus.
Figure 6:
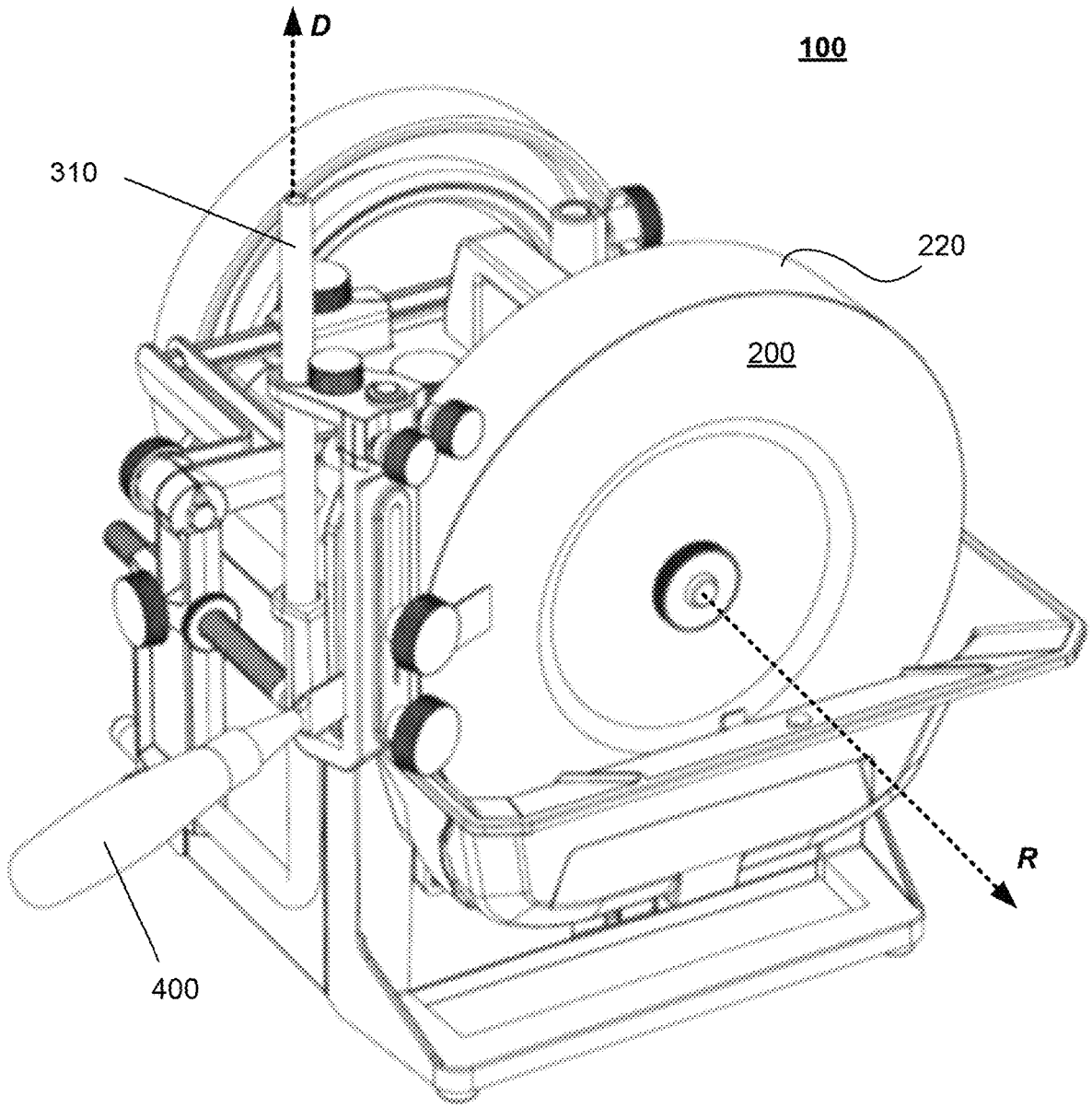
FIG. 6 illustrates a possible position for sharpening an edge tool during a grinding operation using the support element removably attached to the grinding apparatus as shown in FIG. 5.

As can be seen in the figures, for example FIGS. 5 and 6, the elongated member may advantageously be embodied as support bar 310, which is preferably (but not necessarily) a cylindrical support bar. The cylindrical support bar 310 further comprises a first cylindrical leg 311 and a second cylindrical leg 312. The first cylindrical leg 311 and the second cylindrical leg 312 are parallel to each other and extend outwardly from the cylindrical support bar 310.

In advantageous embodiments, the support element 300 further comprises a first support element section 350 and a second support element section 320. The second support element section 320 may be pivotally coupled to the first support element section 350, e.g., by means of a swivel joint 330, a pivot hinge or similar. This allows for increased flexibility in that it is made possible to provide various positions of the first support element section 350 and a second support element section 320, respectively. Providing various positions of the first support element section 350 and the second support element section 320 has the further advantage that the various positions and/or angles for the elongated member (here exemplified by the cylindrical support bar 310) are also enabled.

As can be seen in FIGS. 4-8, the first support element section 350 can be removably attached to an upper surface 115 of the grinding apparatus casing 110. Furthermore, the first support element section 350 is configured to extend outwardly from the grinding apparatus casing 110, when the grinding apparatus 100 is in operation (see e.g. FIG. 6). Furthermore, the second support element section 320 includes first and second holes 321; 322 (see e.g. FIG. 3) configured to receive the first and second cylindrical legs 311; 312 of the cylindrical support bar 310 simultaneously.

Advantageously, the second support element section 320 may additionally include fastening elements 324; 325 configured for fastening the first and second cylindrical legs 311; 312 in the first and second holes 321; 322, respectively. For example, the fastening elements 324; 325 may be embodied as threaded pins with respective knobs as is exemplified in the drawings.

Reference is again made to FIGS. 3-8. The first support element section 350 comprises a beam-shaped element 334 configured to extend in a direction parallel to the rotation axis R of the cylindrical grindstone 200 when the grinding apparatus 100 is in operation. The first support element section 350 may further comprise a third cylindrical leg 313 and a fourth cylindrical leg 314.

Figure 7:
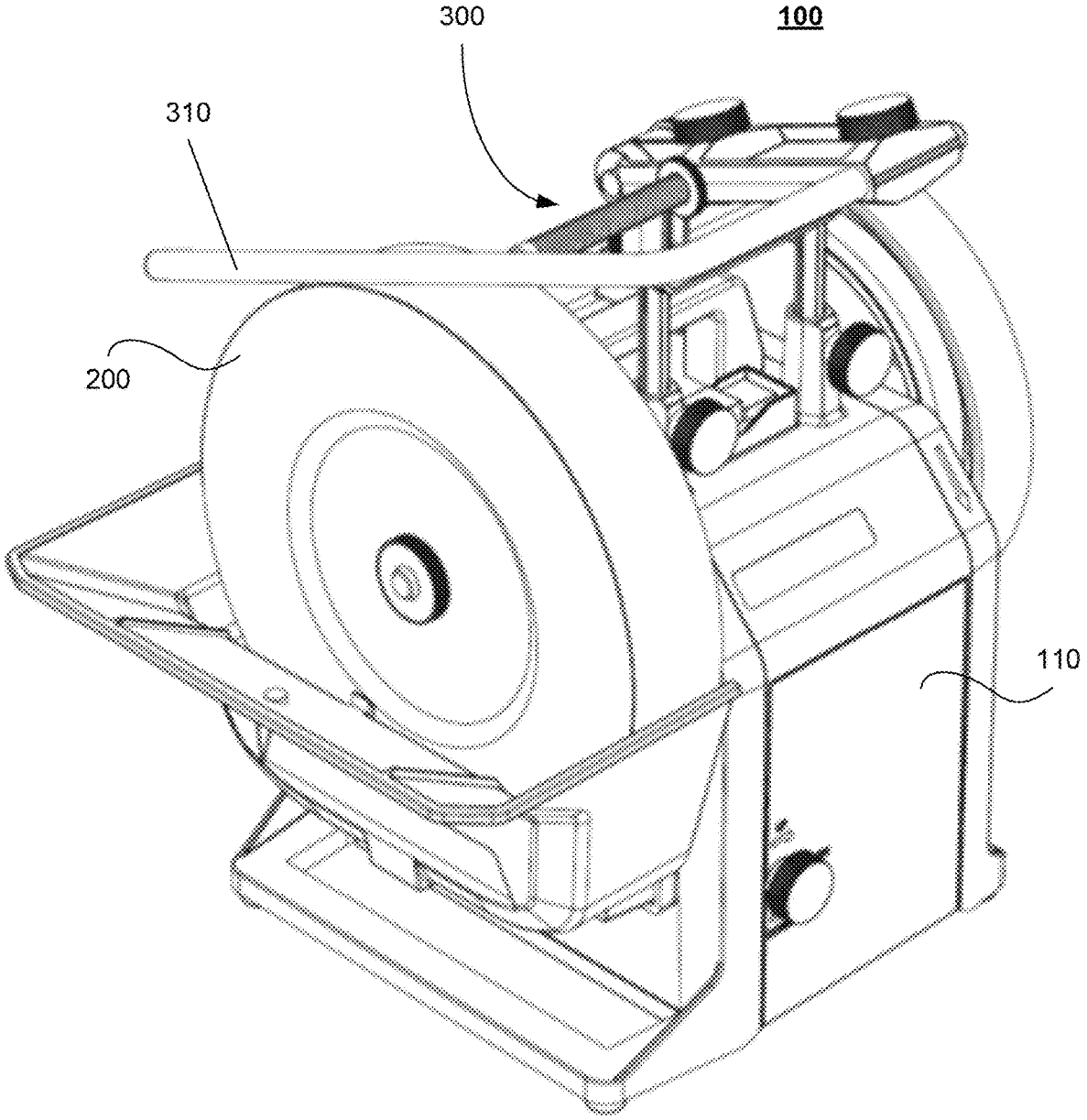
FIGS. 7-8 illustrate alternative possible positions for the support element in FIG. 3 when used in combination with a grinding apparatus.
Figure 8:
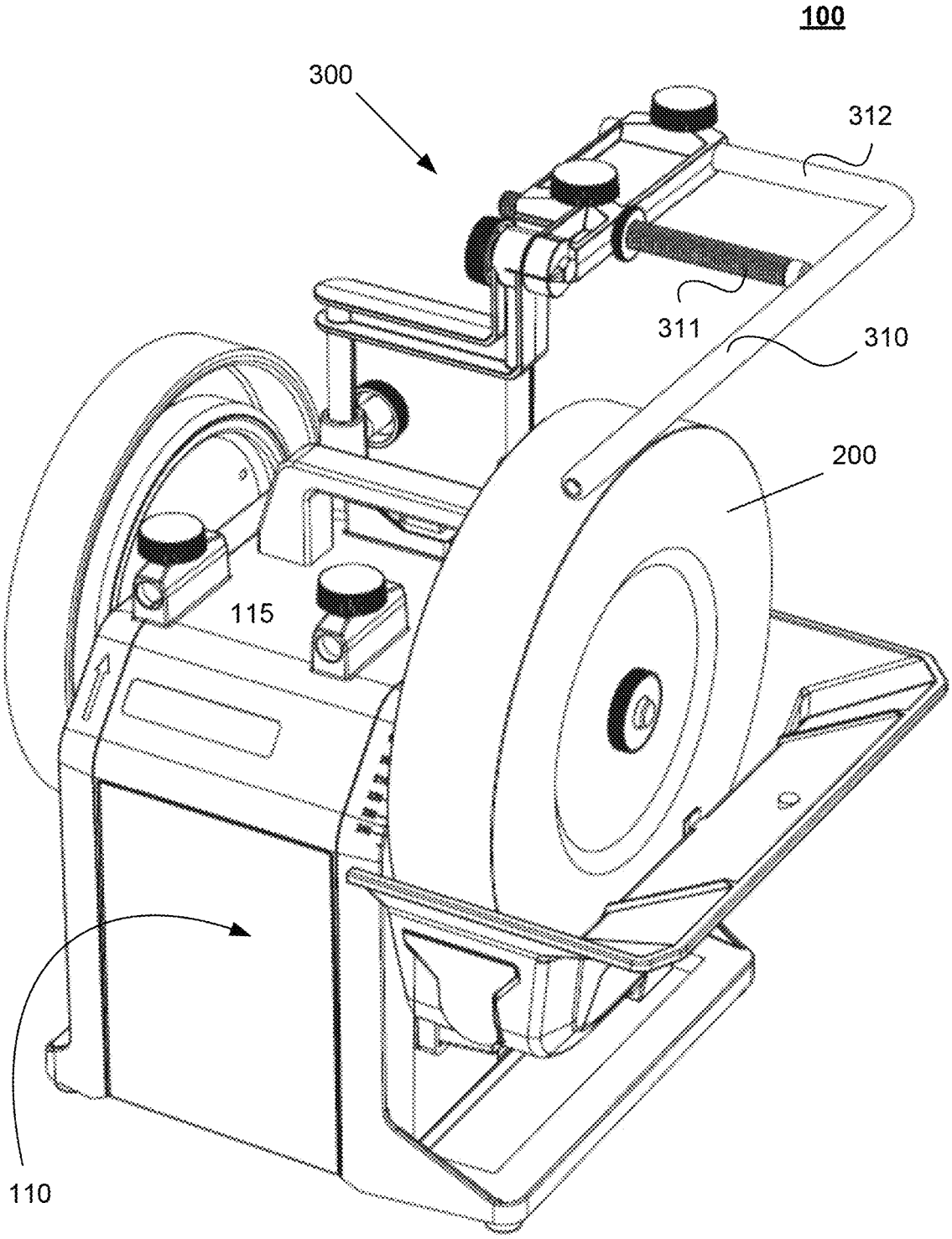

The third cylindrical leg 313 and the fourth cylindrical leg 314 are parallel to each other and extend outwardly from the beam-shaped element 334, e.g. towards a center portion of the upper surface 115 of the grinding apparatus 100 as is illustrated in FIGS. 4-6. FIGS. 7-8 illustrate a different, alternative position, where the third cylindrical leg 313 and the fourth cylindrical leg 314 are parallel to each other and extend outwardly from the beam-shaped element 334 in a direction perpendicularly to a plane coinciding with the upper surface 115 (also known as the top surface) of the grinding apparatus 100. To this end, the grinding apparatus casing 110 may comprise a first bracket 111'; 111" and a second bracket 112'; 112", wherein each bracket includes a respective hole configured to receive the third and fourth cylindrical legs 313; 314 of the first support element section 350 simultaneously. This allows for positioning the support element 300 in many different positions and thus allow for various grinding operation of the user's own choice. This may hence allow increased flexibility and utility of the grinding apparatus 100. As can be seen in the drawings, each bracket may advantageously also include a respective fastening element 116, 117; 118, 119 configured for fastening the third and fourth cylindrical legs 313; 314 in the holes of the first and second brackets, respectively. For example, the fastening elements 116, 117; 118, 119 may be embodied as threaded pins with respective knobs as is exemplified in the drawings.

With continued reference to FIG. 3, it should be further appreciated that, in some advantageous embodiments, one of the first or second holes 321; 322 of the second support element section 320 comprises a circular cross-section and the other of the first or second holes 321; 322 of the second support element section 320 comprises a non-circular cross-section, e.g. an oval cross section. This way, it is made possible to reduce, alleviate or even eliminate any drawer effect that would otherwise occur when the two parallel cylindrical legs 311; 312 of the cylindrical support bar 310 are to be inserted in respective holes 321; 322 simultaneously without compromising with the stability of the cylindrical support bar 310. The hole, the cross-section of which is non-circular, may serve as a guiding means for the user when inserting the cylindrical legs 311; 312 of the cylindrical support bar 310 in their respective holes. This allows for a user-friendly grinding apparatus.

The various aspects and embodiments described in this disclosure allow for grinding operations where an edge tool to be sharpened can be sharpened by means of the parallel side surface facing outwardly from the grinding apparatus casing during the grinding operation. This, in turn, may achieve the advantageous effect that it is made possible to sharpen edge tools using an even grinding phase.

Furthermore, the various aspects and embodiments described in this disclosure provide for grinding operations with increased flexibility, e.g. in the sense that multiple sharpening angles can be provided for a user who desires to sharpen his or her edge tools.

According to some embodiments, the grinding apparatus is also flexible in that the support element can be used with either horizontal or vertical brackets positioned at an upper side of the grinding apparatus casing. This allows the user to find multiple different positions in his/her attempt to find an optimal position for sharpening his or her edge tool.

Still further, various embodiments of the support element described herein are advantageous in that it can be used together with various grinding jigs. For example, an adjustable grinding jig as described in the European Patent No. EP 3 059 048 B1 can be advantageously used in combination with the various embodiments of the support element described throughout this disclosure. This is also schematically illustrated in FIG. 6.

LIST OF NUMBERED EXAMPLE EMBODIMENTS

The technology described in this disclosure thus encompasses without limitation the following Numbered Example Embodiments (NEE's):

NEE1. A grinding apparatus for sharpening an edge tool, the grinding apparatus comprising:

a grinding apparatus casing;

a cylindrical grindstone removably attached to the grinding apparatus casing, the cylindrical grindstone having two parallel side surfaces and a circular periphery surface between said two parallel side surfaces, and the cylindrical grindstone further being rotatable around a rotation axis which is perpendicular to both parallel side surfaces of the cylindrical grindstone; and a support element removably attached to the grinding apparatus casing for supporting an edge tool to be sharpened during a grinding operation; characterized in that the support element includes an elongated member configured to extend in a direction which is perpendicular to the rotation axis of the cylindrical grindstone in such way that a grinding operation is enabled where the edge tool to be sharpened can be sharpened by means of the parallel side surface facing outwardly from the grinding apparatus casing during the grinding operation.

NEE2. The grinding apparatus according to embodiment NEE1, wherein the elongated member is a cylindrical support bar.

NEE3. The grinding apparatus according to embodiment NEE2, wherein the cylindrical support bar further comprises a first cylindrical leg and a second cylindrical leg, wherein the first cylindrical leg and the second cylindrical leg are parallel to each other and extend outwardly from the cylindrical support bar.

NEE4. The grinding apparatus according to embodiment NEE3, wherein the support element further comprises:

a first support element section which is removably attached to an upper surface of the grinding apparatus casing and configured to extend outwardly from the grinding apparatus casing, when the grinding apparatus is in operation;

a second support element section which is pivotally coupled to the first support element section; and wherein the second support element section includes first and second holes configured to receive the first and second cylindrical legs of the cylindrical support bar simultaneously.

NEE5. The grinding apparatus according to embodiment NEE4, wherein the second support element section includes fastening elements configured for fastening the first and second cylindrical legs in the first and second holes, respectively.

NEE6. The grinding apparatus according to embodiment NEE4 or NEE5, wherein the first support element section comprises a beam-shaped element configured to extend in a direction parallel to the rotation axis of the cylindrical grindstone when the grinding apparatus is in operation, and wherein the first support element section further comprises a third cylindrical leg and a fourth cylindrical leg, wherein the third cylindrical leg and the fourth cylindrical leg are parallel to each other and configured to extend outwardly from the beam-shaped element towards a center portion of the upper surface of the grinding apparatus.

NEE7. The grinding apparatus according to embodiment NEE6, wherein the grinding apparatus casing comprises a first bracket and a second bracket, and wherein each bracket includes a respective hole configured to receive the third and fourth cylindrical legs of the first support element section simultaneously.

NEE8. The grinding apparatus according to embodiment NEE7, wherein each bracket further includes a fastening element configured for fastening the third and fourth cylindrical legs in the holes of the first and second brackets, respectively.

NEE9. The grinding apparatus according to any of the embodiments NEE4-NEE8, wherein one of the first or second holes of the second support element section comprises a circular cross-section and the other of the first or second holes of the second support element section comprises a non-circular cross-section.

NEE10. The grinding apparatus according to embodiment NEE9, wherein the non-circular cross-section is an oval cross-section.

As will be appreciated by the reader of this disclosure, modifications are possible within the scope of the appended claims. Modifications and other variants of the described embodiments will thus come to mind to one skilled in the art having benefit of the teachings presented in the foregoing description and associated drawings. For example, while the embodiments described herein have mainly discussed edge tools those skilled in the art will readily appreciate that the grinding apparatus can equivalently be used for other grindable objects too, e.g. scissors. Therefore, it is also to be understood that the embodiments are not limited to the specific example embodiments described in this disclosure and that modifications and other variants are intended to be included within the scope of this disclosure. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. As used herein, the terms "comprise/comprises" or "include/includes" do not exclude the presence of other elements or steps. Furthermore, although individual features may be included in different claims, these may possibly advantageously be combined, and the inclusion of different claims does not imply that a combination of features is not feasible and/or advantageous. In addition, singular references do not exclude a plurality.

What is claimed is:

1. A support element for use in combination with a grinding apparatus, wherein the support element is removably attachable to the grinding apparatus, and wherein the support element comprises:

a removably attached cylindrical support bar for supporting an edge tool to be sharpened during a grinding operation, the cylindrical support bar comprising a first cylindrical leg and a second cylindrical leg, the first cylindrical leg and the second cylindrical leg being parallel to each other and extending outwardly from the cylindrical support bar; and a first support element section removably attachable to an upper surface of a grinding apparatus casing of the grinding apparatus and further configured to extend outwardly from the grinding apparatus casing, when the grinding apparatus is in operation; and a second support element section which is pivotally coupled to the first support element section; wherein the second support element section includes first and second holes configured to simultaneously receive the first and second cylindrical legs of the cylindrical support bar for removably attaching the cylindrical support bar to the support element; and wherein said cylindrical support bar is configured to extend in a direction which is perpendicular to a rotation axis of a cylindrical grindstone of the grinding apparatus when in operation in combination with the grinding apparatus in such way that a grinding operation is enabled where the edge tool to be sharpened can be sharpened by means of a parallel side surface facing outwardly from the grinding apparatus casing during the grinding operation; and wherein the first support element section comprises a beam-shaped element configured to extend in a direction parallel to the rotation axis of the cylindrical grindstone when the grinding apparatus is in operation, and wherein the first support element section further comprises a third cylindrical leg and a fourth cylindrical leg, wherein the third cylindrical leg and the fourth cylindrical leg are parallel to each other and configured to extend outwardly from the beam-shaped element towards a center portion of the upper surface of the grinding apparatus.

2. The support element of claim 1, wherein the second support element section includes fastening elements configured for fastening the first and second cylindrical legs in the first and second holes, respectively.

3. The support element of claim 1, wherein one of the first or second holes of the second support element section comprises a circular cross-section and the other of the first or second holes of the second support element section comprises a non-circular cross-section.

4. The support element of claim 3, wherein the non-circular cross-section is an oval cross-section.

5. A grinding apparatus for sharpening an edge tool, the grinding apparatus comprising:

a grinding apparatus casing;

a cylindrical grindstone removably attached to the grinding apparatus casing, the cylindrical grindstone having two parallel side surfaces and a circular periphery surface between said two parallel side surfaces, and the cylindrical grindstone further being rotatable around a rotation axis which is perpendicular to both parallel side surfaces of the cylindrical grindstone; and a support element, wherein the support element is removably attachable to the grinding apparatus, and wherein the support element comprises a removably attached cylindrical support bar for supporting an edge tool to be sharpened during the grinding operation, the cylindrical support bar comprising a first cylindrical leg and a second cylindrical leg, the first cylindrical leg and the second cylindrical leg being parallel to each other and extending outwardly from the cylindrical support bar; and a first support element section removably attachable to an upper surface of the grinding apparatus casing of the grinding apparatus and further configured to extend outwardly from the grinding apparatus casing, when the grinding apparatus is in operation; and a second support element section which is pivotally coupled to the first support element section; wherein the second support element section includes first and second holes configured to simultaneously receive the first and second cylindrical legs of the cylindrical support bar for removably attaching the cylindrical support bar to the support element; and wherein said cylindrical support bar is configured to extend in a direction which is perpendicular to the rotation axis of the cylindrical grindstone of the grinding apparatus when in operation in combination with the grinding apparatus in such way that the grinding operation is enabled where the edge tool to be sharpened can be sharpened by means of one of the parallel side surfaces facing outwardly from the grinding apparatus casing during the grinding operation; and wherein the first support element section comprises a beam-shaped element configured to extend in a direction parallel to the rotation axis of the cylindrical grindstone when the grinding apparatus is in operation, and wherein the first support element section further comprises a third cylindrical leg and a fourth cylindrical leg, wherein the third cylindrical leg and the fourth cylindrical leg are parallel to each other and configured to extend outwardly from the beam-shaped element towards a center portion of the upper surface of the grinding apparatus; and wherein the second support element section includes fastening elements configured for fastening the first and second cylindrical legs in the first and second holes, respectively.

6. A grinding apparatus for sharpening an edge tool, the grinding apparatus comprising:

a grinding apparatus casing;

a cylindrical grindstone removably attached to the grinding apparatus casing, the cylindrical grindstone having two parallel side surfaces and a circular periphery surface between said two parallel side surfaces, and the cylindrical grindstone further being rotatable around a rotation axis which is perpendicular to both parallel side surfaces of the cylindrical grindstone; and a support element, wherein the support element is removably attachable to the grinding apparatus, and wherein the support element comprises a removably attached cylindrical support bar for supporting an edge tool to be sharpened during the grinding operation, the cylindrical support bar comprising a first cylindrical leg and a second cylindrical leg, the first cylindrical leg and the second cylindrical leg being parallel to each other and extending outwardly from the cylindrical support bar; and a first support element section removably attachable to an upper surface of the grinding apparatus casing of the grinding apparatus and further configured to extend outwardly from the grinding apparatus casing, when the grinding apparatus is in operation; and a second support element section which is pivotally coupled to the first support element section; wherein the second support element section includes first and second holes configured to simultaneously receive the first and second cylindrical legs of the cylindrical support bar for removably attaching the cylindrical support bar to the support element; and wherein said cylindrical support bar is configured to extend in a direction which is perpendicular to the rotation axis of the cylindrical grindstone of the grinding apparatus when in operation in combination with the grinding apparatus in such way that the grinding operation is enabled where the edge tool to be sharpened can be sharpened by means of one of the parallel side surfaces facing outwardly from the grinding apparatus casing during the grinding operation; and wherein the first support element section comprises a beam-shaped element configured to extend in a direction parallel to the rotation axis of the cylindrical grindstone when the grinding apparatus is in operation, and wherein the first support element section further comprises a third cylindrical leg and a fourth cylindrical leg, wherein the third cylindrical leg and the fourth cylindrical leg are parallel to each other and configured to extend outwardly from the beam-shaped element towards a center portion of the upper surface of the grinding apparatus.

7. The grinding apparatus of claim 6, wherein the grinding apparatus casing comprises a first bracket and a second bracket, and wherein each bracket includes a respective hole configured to receive the third and fourth cylindrical legs of the first support element section simultaneously.

* * * * *